US005084922A

United States Patent [19]

Louit

[11] Patent Number: 5,084,922

[45] Date of Patent: Feb. 4, 1992

[54] SELF-CONTAINED MODULE FOR INTENSIVE CARE AND RESUSCITATION

[75] Inventor: Claude Louit, Riscle, France

[73] Assignee: Societe Louit SA, Riscle, France

[21] Appl. No.: 354,992

[22] Filed: May 19, 1989

[30] Foreign Application Priority Data

May 19, 1988 [FR] France ..... 88 07046

[51] Int. Cl.[5] ..... A61G 1/02; A61G 7/00

[52] U.S. Cl. ..... 5/81.1; 5/611; 296/20

[58] Field of Search ..... 5/60, 81 R, 81 B, 83, 5/86, 63, 64, 508; 296/20

[56] References Cited

U.S. PATENT DOCUMENTS 3,644,944 2/1972 Bourgraf et al. ..... 296/20
3,980,334 9/1976 Fernean et al. ..... 296/20
4,052,097 10/1977 Weil et al. ..... 296/20

FOREIGN PATENT DOCUMENTS 2538411 8/1975 Fed. Rep. of Germany .
2274 1/1978 Fed. Rep. of Germany .
8530826 2/1986 Fed. Rep. of Germany .
3631409 3/1988 Fed. Rep. of Germany ..... 296/20
2506153 11/1982 France .

*Primary Examiner*—Alexander Grosz
*Attorney, Agent, or Firm*—Horst M. Kasper

[57] ABSTRACT

The self-contained module for intensive care and resuscitation includes a detachable receiver table for sick and injured persons, medical assistance equipment and resuscitation equipment, and a footing furnished with ground-support members. The module is characterized in that it comprises a girder (1) which supports the different module units and the table, and which is supported in an adjustable manner above the ground, i.e. adjustable in height and/or inclination, by the footing, which is formed by at least two support legs (7) associated with the operating and guide means, which operating an guide means communicates to the support legs a folding-up or unfolding motion under the girder simultaneously or independently for each leg.

32 Claims, 9 Drawing Sheets

FIG. 7
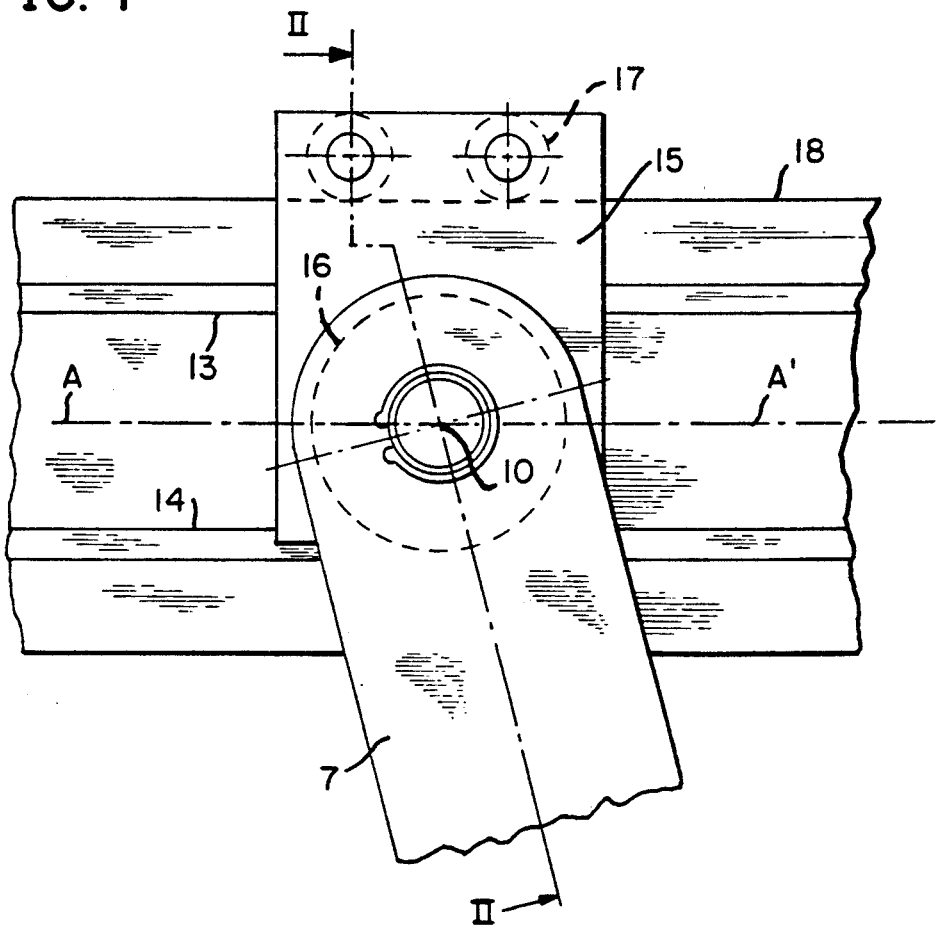
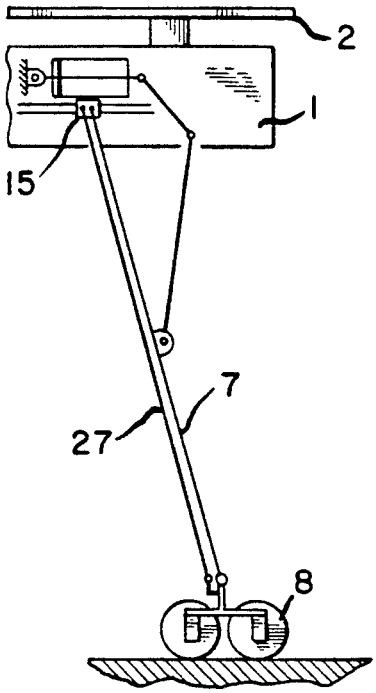
FIG. 10

SELF-CONTAINED MODULE FOR INTENSIVE CARE AND RESUSCITATION

BACKGROUND OF THE INVENTION

1. Field of the Invention

The present invention relates to a self-contained module for intensive care and resuscitation which module can be used in the transport of sick and injured persons to a medical care center.

2. Brief Description of the Background of the Invention Including Prior Art

The transport of sick and injured people to medical care centers requires the use of specially furnished vehicles, outfitted with all the equipment necessary for the resuscitation and for the medical assistance. The operating costs of these vehicles, in particular of air-transport vehicles, are very high. The reason for this is, on the one hand, their specific use and, on the other hand, the high degree of technical sophistication of the medical apparatus with which these vehicles have to be equipped.

In order to reduce the operating costs of this type of vehicle, the solution would be to use these vehicles at certain points for purposes other than those initially planned. Nevertheless, such a solution is very difficult to implement since it requires the full demounting of the medical equipment The size of a fleet of such vehicles is very small and, in particular, the vehicles for air transport are not always available at a desired point in time. Since the members of the First Aid Squad cannot use the regular vehicles, they have to await the arrival of these ambulance vehicles for the evacuation of sick and injured people.

Moreover, in the absence of ambulance vehicles, the injured person cannot be helped at the accident site by an optimum technical environment, which includes various equipment for respiratory and cardiac care, and other equipment.

The German Petit Patent DE-GB 8,530,826.9 to Burkhart Brücher teaches a support for invalids. The support for the invalids can be assembled at the location of use.

The European Patent Application, Publication No. 0,002,274, to Helmut Hess teaches a first-aid capsule for accommodating and treating of accident victims showing undercooling effects and hypothermic symptoms.

The French Patent 2,506,153 to Patrick Petit teaches a stretcher and its carriage support for an ambulance.

The German Patent Application Laid Out 2,538,411 to Binz GmbH teaches a stretcher-support frame with liftable, spring-supported carrier support.

All this equipment is associated with the disadvantage that it is fairly bulky and difficult to store in a space-saving way.

SUMMARY OF THE INVENTION

1. Purposes of the Invention

It is an object of the present invention to eliminate the above-recited inconveniences by employing a self-contained module for intensive care and resuscitation.

It is a further object of the present invention to provide a first-aid module which is detachable and which is of a reduced volume so that it can be introduced in most of the vehicles for land and air transport.

It is yet a further object of the invention to provide a self-contained first-aid module of low weight, in particular to be able to be transported with the injured person by air-transport vehicles.

It is yet a further object of the present invention to provide and to produce a specially-equipped module for carrying of injured and sick persons.

These and other objects and advantages of the present invention will become evident from the description which follows.

2. Brief Description of the Invention

The present invention provides a self-contained module for intensive care and resuscitation. Said module comprises a detachable receiving table for sick and injured persons, and medical and resuscitation assistance equipment. A footing is furnished by ground-support members including at least two support legs. A girder is supporting the table and the medical and resuscitation equipment. A footing is attached to the girder for supporting and controlling the height level and/or inclination of the girder above the ground. Actuating and guide means are attached to the girder and associated with the footing. Said actuating and guide means communicate to the support legs a folding-up or unfolding motion under the girder simultaneously or independently relative of the individual support legs.

Actuating and guide means can support a folding-up and unfolding motion of each support leg formed by a combination of a translation motion with a rotation motion. During the folding-up, the rotation motion can be effected under and toward the girder and toward the end of the girder. The support leg can support in an unfolded position, while the translation motion can be effected under the girder and toward the other extremity and, during unfolding, the translation motion can be effected under the girder in direction of the end. Each support leg can support in an unfolded position, an unfolding of the respective support leg while the rotation motion can be effected under the girder.

The girder can have a recess. In a folded-up position, the actuating and guide means of the support legs and the support legs themselves can become placed in the recess of the girder in part or completely so as to reduce the spacing relative to ground.

The actuating and guide means can comprise members for guiding in translation along an axis line parallel to the longitudinal axis of the girder. Said members can cooperate with the upper part of the support leg, by means of a first hinge point. A rotation guide member along a circumferential arc can be centered at a point located at a small offset relative to the girder. Said rotation guide member can cooperate by means of a second hinge point with the support leg, this second hinge point being located between the first hinge point and the lower end of the support leg. A motor drive means can directly operate to actuate the legs either via the rotation guide members or via the translation guide member.

The motor drive means are non-reversible

The two support legs and the associated operating and guide means can be placed under and respectively in the girder and on both sides of a vertical center plane containing the longitudinal axis of the girder.

A path of the lower end of each support leg during the folding-up can be located within a straight line perpendicular to the girder and can pass through said lower end of the respective support leg in view of the completely unfolded support leg.

A second hinge point of the support leg can be located at mid distance between the first and the lower end of the support leg. The center point of the circumferential arc, along which this second hinge point moves about, can be located within the straight line, recited above, below the axis along which there can occur the translation displacement of the first hinge point.

The ground-support members can be hingedly mounted at the end of their support leg and can be interdependent of actuating and guide means. Said actuating and guide means can communicate to ground support members and to the respective support leg, relative to an attached reference point, wherein a resulting tilting motion can run simultaneously with the folding-up and unfolding motions of the said support leg.

The ground-support member can be induced to a translation motion during the folding-up or unfolding of the associated support leg relative to an attached reference point relating at the girder.

Each actuating and guide means of the ground-support member, in relation to the support leg at which it can be hinged, can be disposed within the said support leg.

Each actuating and guide means for tilting of the ground-support member, in relation to the support leg at which it can be hinged, can be formed by: a first toothed chain wheel disposed coaxial relative to the hinge axis of the first point and fixed at the carriage both relative to a rotation as well as relative to a translation, a second toothed chain wheel identical to the first toothed chain wheel, disposed coaxial relative to the hinge axis of the structure of the support member, and fixed both relative to a rotation as well as relative to a translation to the said structure, and an endless chain which cooperates by engaging with the first chain wheel and the second chain wheel.

Each actuating and guide means can be formed by a rigid triangle disposed in the support leg associated with this member and attached and fixed in a hinged manner for tilting of the ground-support member relative to the support leg, at which leg the actuating guide means can be hinged. Said association of the support leg to the member can be furnished on the one hand, by the lower end of the leg to the structure of the support member and, on the other hand, by the upper end of the leg to the carriage, where this triangle can define, together with the support leg, a deformable parallelogram.

The self-contained module for the intensive care and resuscitation includes a detachable receiver table for the sick and injured, medical assistance and resuscitation equipment, and a footing system furnished with ground-support members. Said module comprises a girder 1 which supports the different equipment units and the table. Said girder 1 is supported above the ground in an adjustable manner, for controlling the height and/or the inclination, by the footing. Said footing is formed by at least two support legs 7 associated with actuating and guide means. The actuating and guide means imparts a folding-up or unfolding motion to the support legs, simultaneously or independently one from each other, under the girder.

Such a self-contained module, due its low weight and its low space requirements, can be very easily transported to an accident site and can be put immediately into operation.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 7 is a front elevational view of the upper part of a footing system, FIG. 10 is a schematic view of another embodiment of the actuating means by tilting each ground-support member with respect to its support legs.

DESCRIPTION OF INVENTION AND PREFERRED EMBODIMENT

Figure 1:
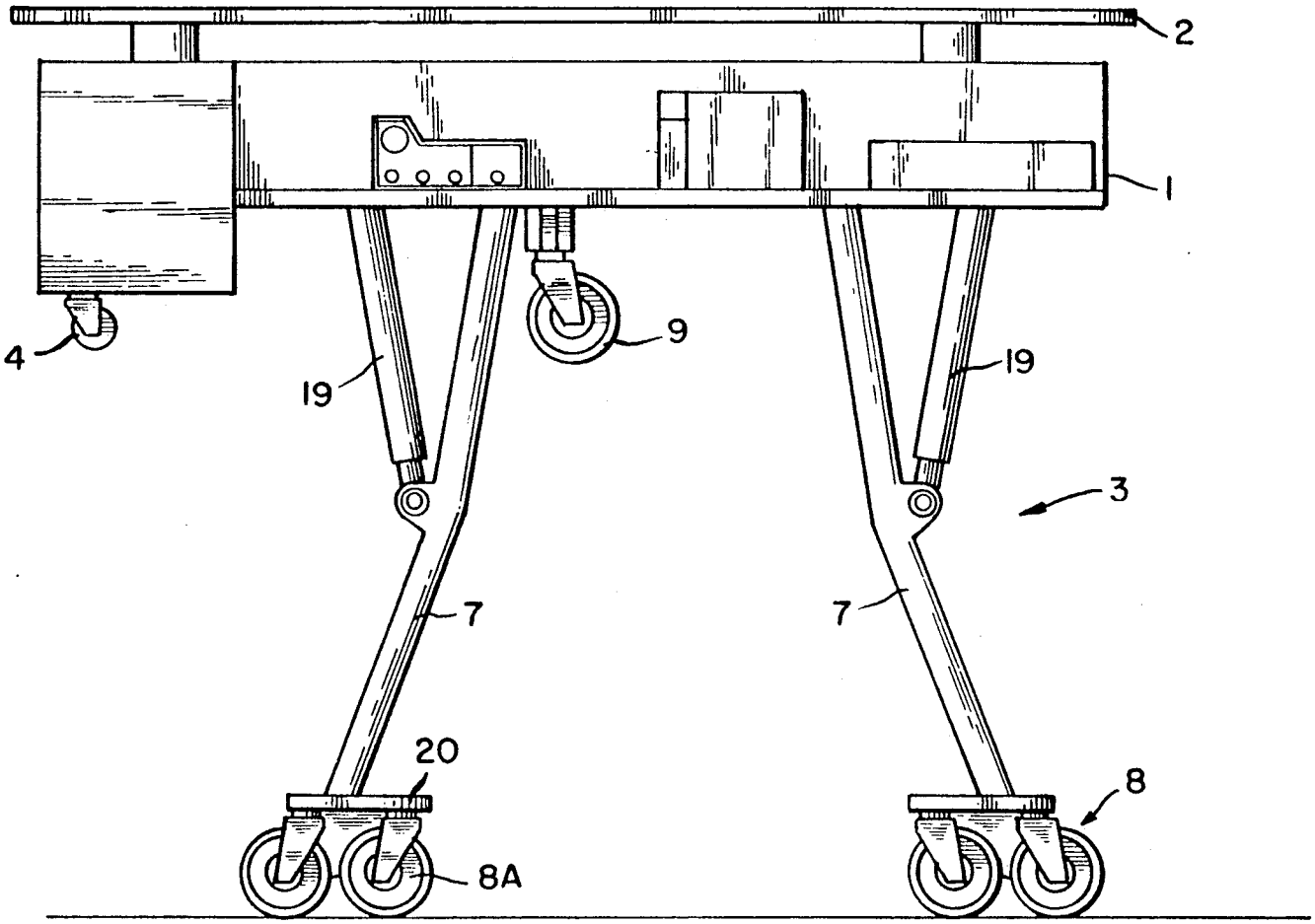
FIG. 1 is a schematic elevational view of the invention module.
Figure 2:
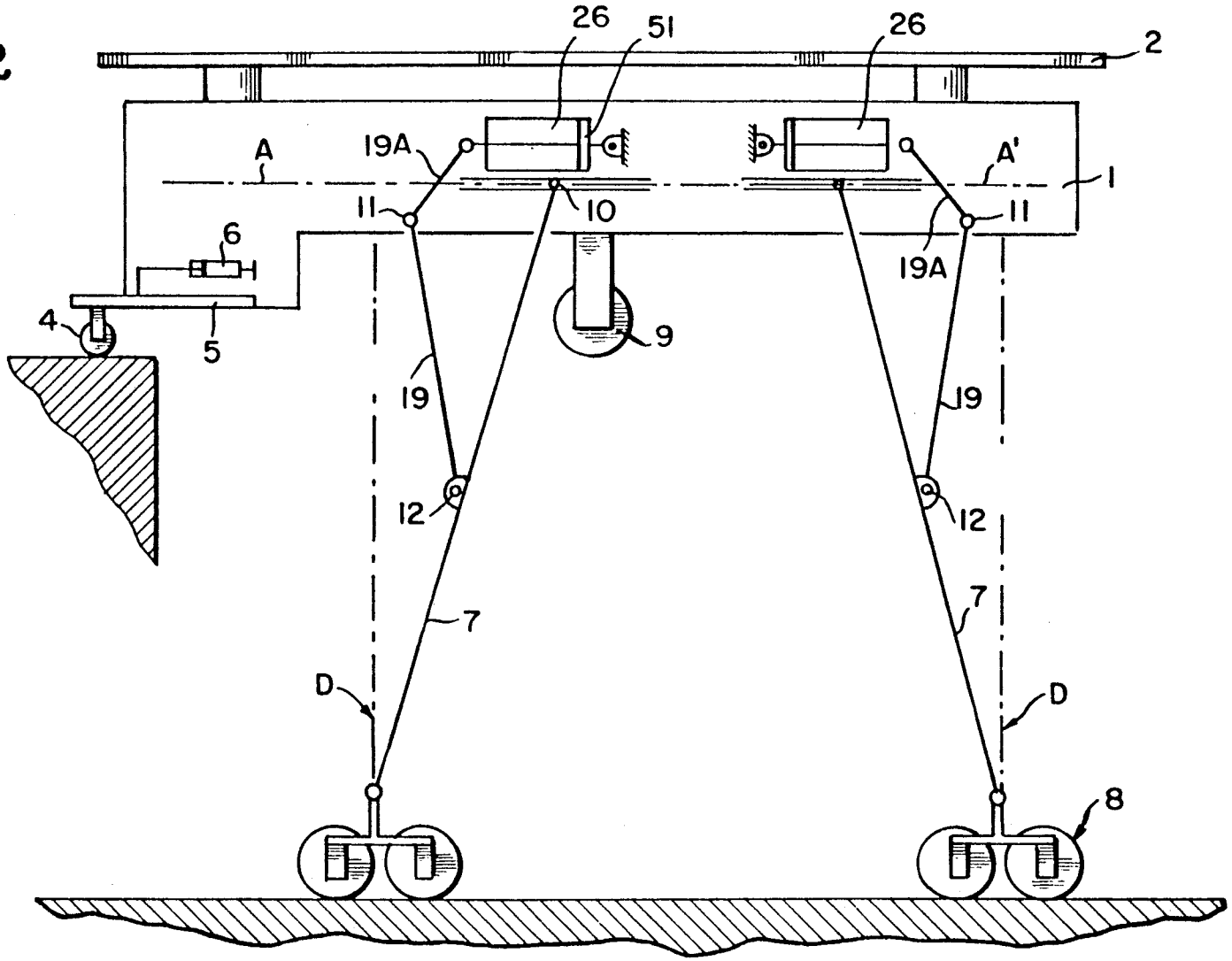
FIG. 2 illustrates, in a schematic fashion, the unfolding of the footing members under the horizontal girder.

As illustrated, the self-contained module for intensive and resuscitation care comprises a girder 1, having a hollow center, made of a light-weight alloy. A receiver table 2 for the injured or sick is removably and detachably disposed on the girder 1. This receiver table 2 can be a solid plane. The girder 1 is furnished on the sides with the equipment necessary for the medical assistance and for the resuscitation and is supported above the ground in a fashion controlling the height and/or the inclination by a footing 3. The footing 3 can be folded up and unfolded below the girder so as to bring the girder to a height even with the floor of the transport vehicle, to place the one end of the girder onto the floor of the transport and then to proceed to the complete entering of the module while simultaneously folding the footing of the girder, and also in a fashion which allows to perform the reverse operation.

Advantageously, the module is equipped at the front end, with omnidirectional roller or running members 4 for being supported on the floor of the transport vehicle, during a loading or unloading operation of the module.

Preferably, these roller members 4 are mounted on a structure 5. The structure 5 can be extracted in part from the girder 1 or retracted totally by a translation movement along an axis parallel to the longitudinal center axis of the girder. This structure 5 is put into operation by a motor drive member associated with jack 6.

The roller members and the structure 5 supporting the roller members can be placed in front of the girder in order to facilitate, on the one hand, the loading of the module and, on the other hand, to keep the footing members as far as possible away from the vehicle body so that the footing members cannot damage the vehicle during the folding-up or unfolding. Subsequently, the structure and the roller members 4 can be pulled back into the girder 1 for space-requirement reasons.

The structure 5 comprises a horizontal partition wall provided with two vertical side wings by means of which it is interdependent of the guide members in translation movement, provided for example by sliding guide grooves 5A. These sliding guide grooves 5A are disposed parallel to the longitudinal center axis of the girder 1.

The roller members are fixed to this partition wall by screws or any other means. These members extend fully under this partition wall.

The operating motor drive member can be, for example, formed by a hydraulic jack 6, which hydraulic jack 6 is fixed, on the one hand, to the girder by means of a shell fork, and on the other hand, to the structure 5, again by means of a shell fork. This hydraulic jack 6 is connected to a corresponding hydraulic circuit, which hydraulic circuit is disposed in the girder comprising hydraulic distributors associated with manual controls. By means of one of these controls and of the associated distributor, it is possible to induce the extending or the contracting of the piston rod of the jack 6 and to induce the extending or the contracting from or into the girder of the roller members via sliding guide grooves 5A and of the structure 5.

Preferably, the girder is furnished at mid-length with two lateral ground-support members, each of which is formed by a roller wheel 9.

The footing 3 of the module comprises at least two support legs 7. Each support leg 7 carries at the lower end a ground-support member 8. Each ground-support member 8 preferably comprises omnidirectional roller wheels 8A. The leg 7 cooperates with the actuating and guiding means. The actuation and guide means maintains the legs 7 in position or imparts to the legs 7 an unfolding or folding-up motion.

The folding and unfolding motion of each leg is brought about by the combination of a rotation motion and of a translation motion. These two motions are imparted to the leg by the actuating means as well as by the guide means.

The roller members 8 of the leg are disposed along the complete folding position to the right one of the two ending parts of the girder. Starting from the complete folding position each leg unfolds as follows by performing a rotation motion around the upper end of the respective leg 7 and simultaneously by a translation motion of the said upper end of the respective leg 7.

The rotation motion is carried out to decrease a a spacing between the members 8 and a first end part of the girder 1. The translation motion is carried out parallel to the longitudinal axis of the said girder 1 in a direction of a second end part of the girder part.

The folding motion of the leg is carried out in a reverse way relative to the unfolding motion.

Each support leg 7 moves about in a vertical plane parallel to the longitudinal center axis of the girder 1. The folding motion of the support legs 7 is effected in such a way that the ground support members 8 each find themselves disposed in the neighborhood of the corresponding end of the girder 1, or during contraction or withdrawal, while the said support legs 7 are fully folded up. According to this position, the module rests preferably on the ground always by means of the support members 8 but, according to another embodiment, the module can rest on the ground by means of the girder 1. In this case, the members 8 can be fully withdrawn into the girder 1.

According to a preferred embodiment, the two support legs 7 are kinematically independent one of the other, and this allows to unfold the two support legs 7 or to fold them up independently one from the other. Furthermore, the support legs 7 can be maintained along a fixed position independent of the position of the other support leg 7, which can be, at that moment, in a mobile or immobile position. This characteristic offers several advantages, in particular the advantage of being able to dispose the girder 1 and the table 2, carried by the girder 1, at a slope or at an incline.

Another advantage derived from this characteristic feature resides in the ease for introducing or for withdrawing of the module from the transport vehicle. In fact, based on this kinematic independence, the front support leg 7 can be folded up while the module is supported by the front roller wheels 4 on the floor of the vehicle and by the roller wheels of the member 8 of the back support legs 7 on the ground.

The motion of the front leg 7 will be effected until the roller wheels 4 of the member 8 come up to the height of the floor of the vehicle such as to be able to be supported on the floor of the vehicle by the entering motion of the module. The entering of the module is continued until the center roller wheels 9 come to be supported on the floor, following to which the folding-up motion of the rear leg 7 can be performed. It has to be noted that the projection of the center of gravity of the module is contained in the support polygon defined by the center roller wheels 9 and the front roller wheels 4 or, if this projection is outside, is situated in the immediate neighborhood of this polygon.

After a full folding of the rear support leg 7, the module can be fully entered into the vehicle and can be supported in a stowage position.

Advantageously, the two units, each formed by a support leg 7 and by its actuation and guide means 19, are respectively located under and in the girder and, preferably, on both sides of a vertical center plane. The center plane contains the longitudinal axis of the girder 1, such as during the folding up. The two support legs 7, on the one hand, in part penetrate into the girder in order to decrease the distance to the ground and, on the other, cannot come into collision. This arrangement allows also the putting into effect of a module of a shorter length, which module is compatible with the dimensions of the transport volume of the transport vehicle.

According to a preferred embodiment, the actuating and guide means 19, which communicate to each support leg 7 a folding-up motion or a unfolding motion, include each Members for guiding in a translation direction along an axis parallel to the longitudinal center axis of the girder 1, which cooperate by means of a first hinge point 10 with the upper part of the support leg 7, where the axis of the first hinge point is perpendicular to the plane on which the support leg 7 moves about.

At least one member 19 for guiding in rotation along a circumferential arc is centered at a point 11 located at an end of the girder 1, or slightly offset relative to the latter girder 1. The member 19 cooperates by means of a second hinge point 12 with the support leg 7, where this second hinge point 12 is located between the first point and the lower end of the support leg 7, and where the axis of this hinge point 12 is perpendicular to the plane in which the support leg 7 moves about.

A motor means 26 acts directly for operating the unit, be it the rotation-guide members, be it the translation-guide members.

Preferably, the path of the lower end of each support leg 7 during the folding up and unfolding motion is located on or within the straight line D perpendicular to the girder 1 and passing through the said end in case of a completely unfolded support leg 7. The expression "moved about within the straight line D" means that the lower end of the support leg 7 moves about in the zone situated between the straight line D and another straight line perpendicular to the center part of the girder 1, for example.

Based on this disposition, the ground-support members 8 can be kept at a distance from the vehicle body during the unfolding and folding up. The lower end of the support leg 7 is not far away from the said straight line D in an intermediate position. For this reason, the support polygon, defined by the support members 8, is deformed very little during the course of the folding up and unfolding of the support legs 7. This lack of deformation allows to obtain a degree of constant stability whatever the position of these support legs 7 is. It is stated merely for reference that the second hinge point 12 of the support leg 7 is located at mid-distance between the first point 10 and the lower end of the support leg 7, and the center of the circumferential arc, along which said second hinge point 12 moves, is located within the afore-cited straight line, and below the axis AA' along which the translation motion of the first hinge point 10 occurs.

According to another embodiment, the point 11 is located at the intersection of the straight line D with the axis along which the first hinge point 10 moves about.

The guide members in translation direction include an upper rail 13 and a lower rail 14, both disposed parallel to the longitudinal center axis of the girder 1, and both disposed at a distance from one another along a same vertical plane, with which rails 13, 14 cooperate in guiding in a translatory direction a carriage 15, which carriage 15 includes a first hinge point 10.

According to a preferred embodiment of the invention, the carriage 15 is furnished with a roller member 16, loosely mounted on an axis. This roller member 16 is introduced in an intermediate space between the rails 13 and 14 and is supported on the one or the other rail 13, 14, depending on which support member 8 is supported or not supported on the ground. In order to avoid rotation of the roller member 16 relative to a geometric axis, the carriage 15 is furnished with a guide mounting 17, formed by two juxtaposed small pulleys which cooperate both in rolling with an upper flat guide surface 18, provided on the upper rail 13. An axis 15A is fixed to the carriage 15, which axis extends perpendicular to the motion plane of the support leg 7. This axis 15A engages in two support bearings 7B furnished at the end of the support leg 7. The axis 15A and the support bearings 7B form the first hinge point 10.

The rotation-guide is formed for example by an arm member 19 hingedly supported by one of its ends at the support leg 7 along the second hinge point 12. This arm member 19 is likewise hingedly supported at the girder 1 along the point 11. Preferably, the arm 19 is extended beyond the point 11 for cooperating with the motor drive means 26.

Preferably, this motor drive means 26 is formed by a dual-action hydraulic jack 6 mounted in the girder 1, fixed to the girder at the body of the hydraulic jack 6, by means of a hinge the hydraulic jack 6 is with its piston rod, by means of a hinge at the end of an extension 19A of the arm 19. This hydraulic jack 6 is connected to the hydraulic circuit of the module and is associated to at least one distributor operated by a manual or electric control.

Advantageously, the motor drive means utilized is irreversible in the sense that an external action exercised on this motor drive means cannot provoke the motion of these motor drive elements. This is to avoid the folding up of the support legs 7 under the effect of only the weight of the module and the unfolding of the support legs 7 under the effect of their own weight. Furthermore, this characteristic allows the maintaining of the support legs 7 in an intermediary position.

The irreversibility of the motor member, formed by a hydraulic jack 6, will be assured by its hydraulic distributor which is furnished on its pull-out side by a position according to which the hydraulic jack blocks the hydraulic conduits which are connected to the front chamber and to the rear chamber of the hydraulic jack.

Advantageously, the ground-support members 8 are hingedly mounted at the end of their support legs 7 along an axis perpendicular to the motion plane of said support legs 7. The ground-support members 8 are joined to actuating means which communicates to them a tilting motion jointly with the unfolding and folding-up motions of said support legs 7 relative to a reference point relating to their support legs 7. This tilting motion is realized such that the support member 8, relative to a reference point relating to the girder 1, is induced into a translatory motion jointly with the unfolding and folding-up motion of the support legs carried by the support member 8. In this manner, the ground-support members 8 are always moved parallel to themselves.

According to a preferred embodiment, the support member 8 of each support leg 7 comprises a structure 20 which carries the roller wheels 8A, for example, in a number of four or two. An axis 21 is fixed to this structure 20. The axis 21 engages at its lower end into two end bearing supports 22 furnished in the support leg 7 at its lower end.

Each support leg 7 is hollow and its inner volume receives the actuating tilting means of its support member 8 according to a preferred embodiment. This actuating tilting means is formed for example by a first toothed chain wheel 23 disposed coaxial to the hinge axis of the first hinge point 10 and fixed both relative to a rotation as well as to a translation motion to the carriage 15.

A second toothed chain wheel 24, identical to the preceding chain wheel 23, and coaxial to the hinge axis 21 of the structure of the support member 8 and fixed both in rotation as well as in translation motion to the said structure.

An endless chain 25 which cooperates in meshing and engaging with the first chain wheel and the second chain wheel.

Advantageously, the first chain wheel 23 and the second chain wheel 24 are respectively supported on the axis 15A and on an axis 21.

According to another embodiment, the tilting actuating means of each support member 8 is formed by a rigid triangle 27 (FIG. 10) disposed in the support leg 7 associated with this member and attached and fixed in a hinged manner, on the one hand, by its lower end at the structure of the support member 8 and, on the other hand, by its upper end at the carriage 15 or at a small foot placed on the latter carriage 15. This triangle defines with the support leg 7 a deformable parallelogram.

The described module is provided with an entirely self-contained energy source. Thus, the hydraulic circuit of the module will be equipped with a hydraulic pump of a suction type and a forcing type associated to a liquid reservoir and operated by an electric motor fed by one or several electric batteries. These different members are placed in the compartments furnished in the girder 1.

This module furnishes the advantage of having a low weight and a reduced volume once the support legs 7 are folded up. This allows transport of the module by air means, for example, by helicopters. Furthermore, based on these properties, the module can be transported by hand to the accident site itself. This allows to bring an optimal technical environment to an injured person and this occurs while awaiting transport means. Finally, it is noted that the wheels 8A of the invention module can be furnished detachable in order to be replaced by wheels of a larger diameter, which allows to facilitate the movement of the module on undulating terrain.

Figure 3:
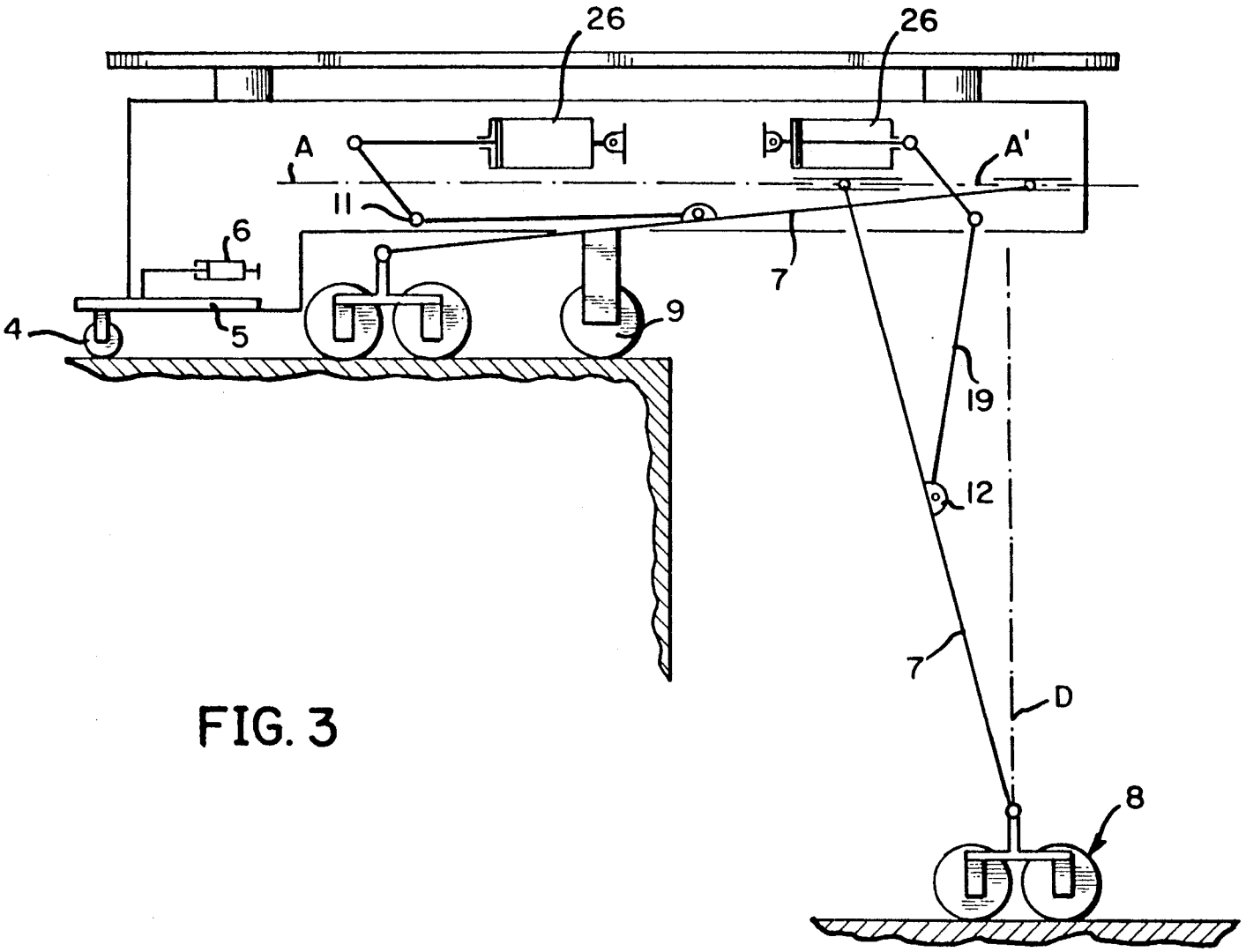
FIG. 3 is a second view the unfolding of the footing members under the horizontal girder.
Figure 4:
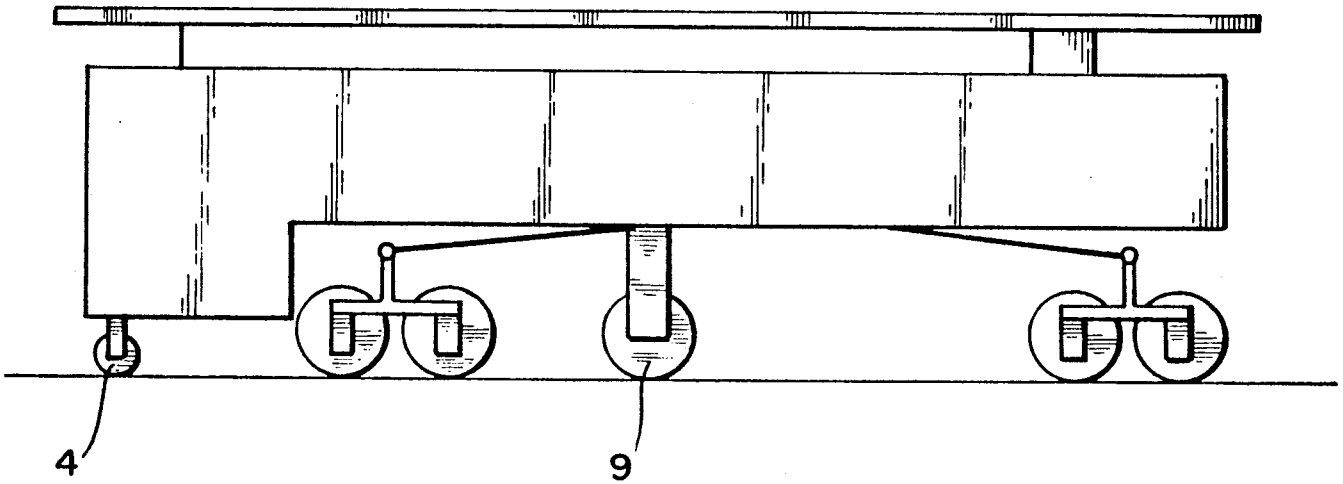
FIG. 4 is yet another view of a possibility of implementing the unfolding of the footing members.
Figure 5:
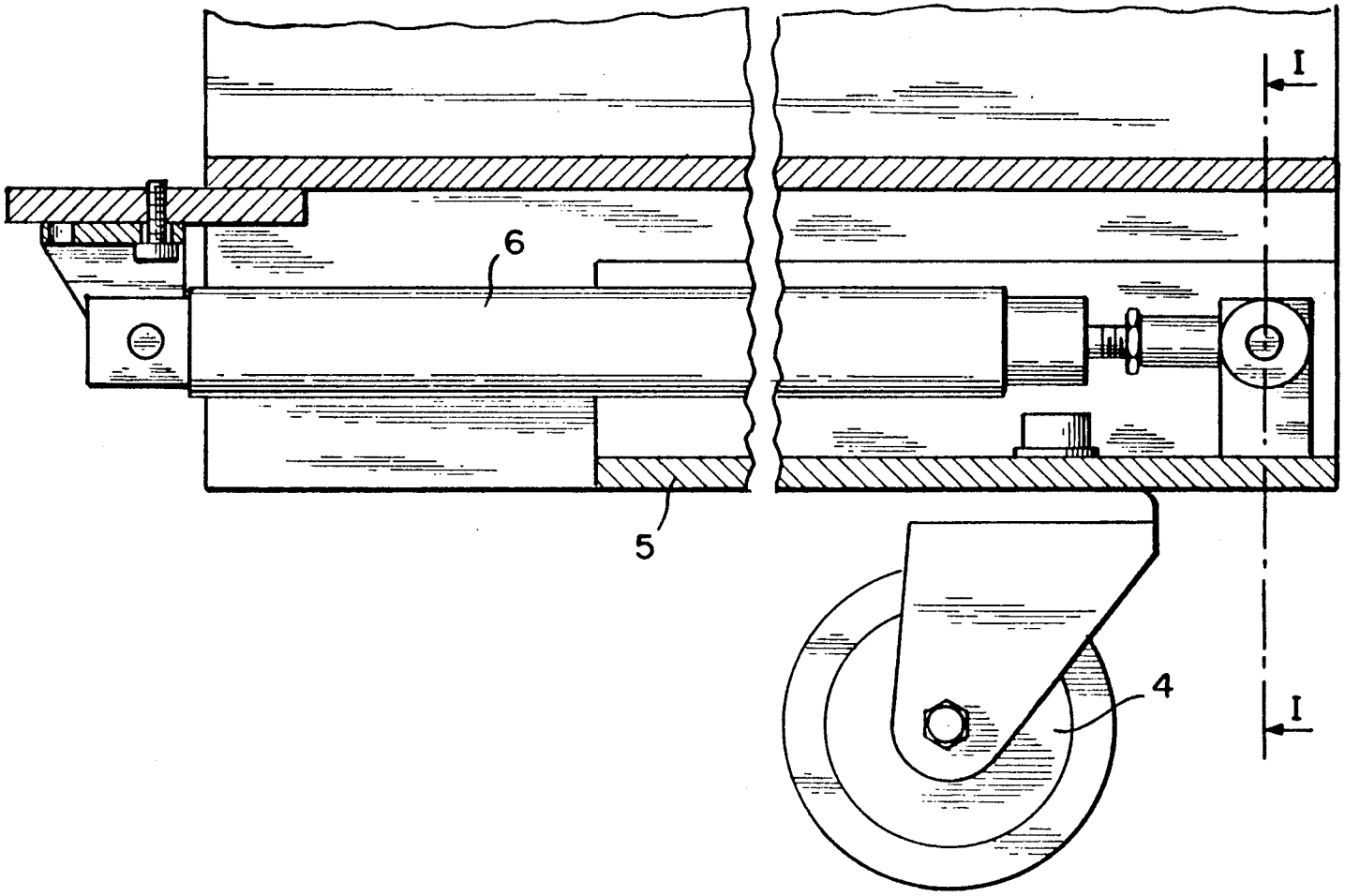
FIG. 5 is a sectional view which shows the front roller members and the structure which supports them.
Figure 6:
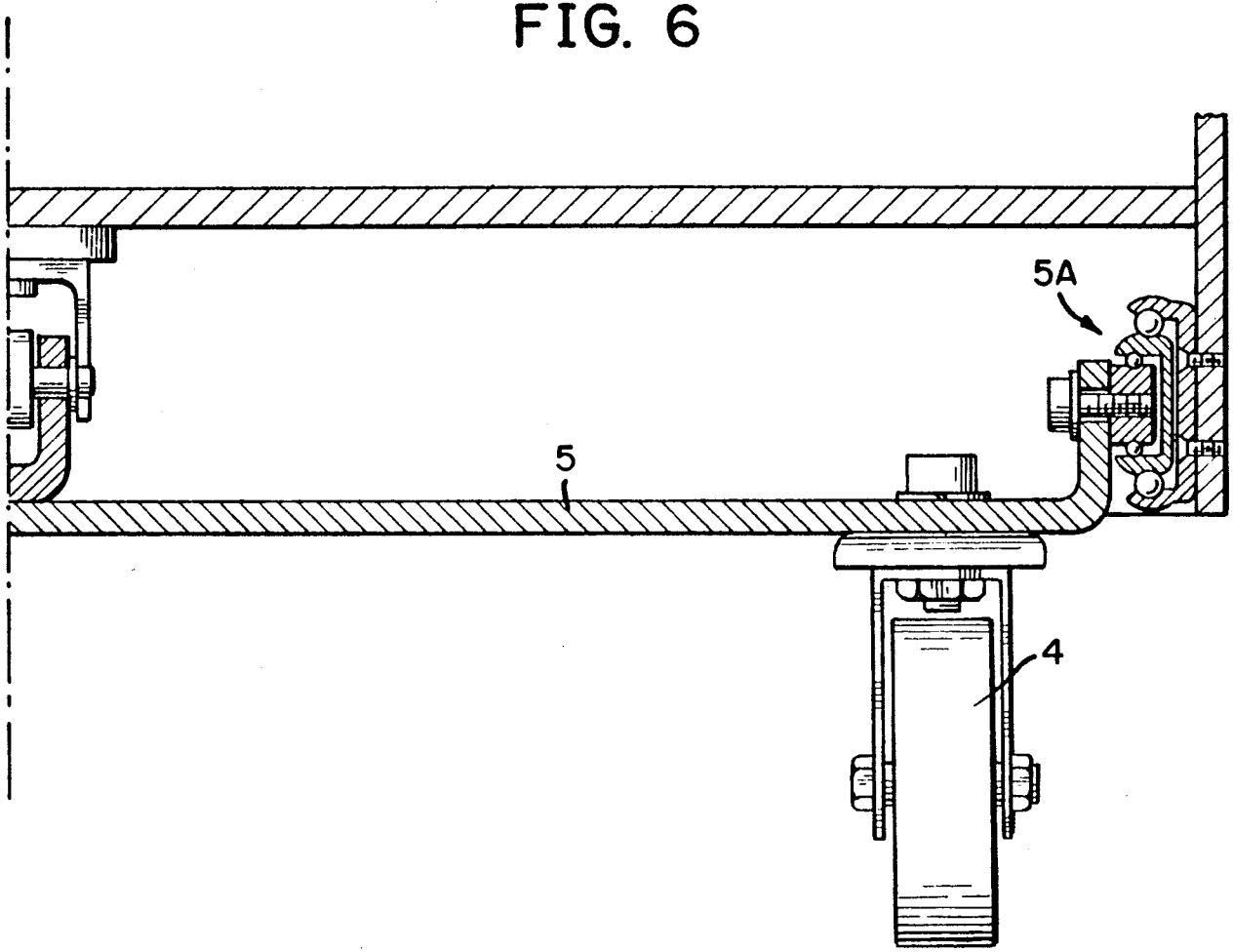
FIG. 6 is a cross-sectional view along the section line I.I of FIG. 5.
Figure 8:
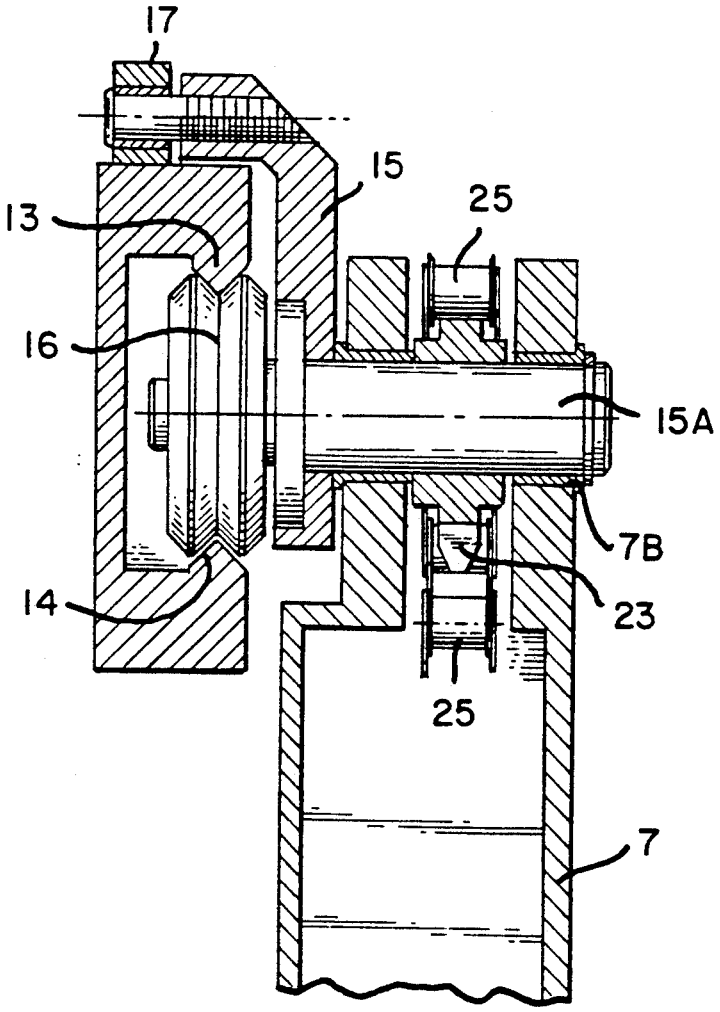
FIG. 8 is a sectional view along section line II.II of FIG. 7.
Figure 9:
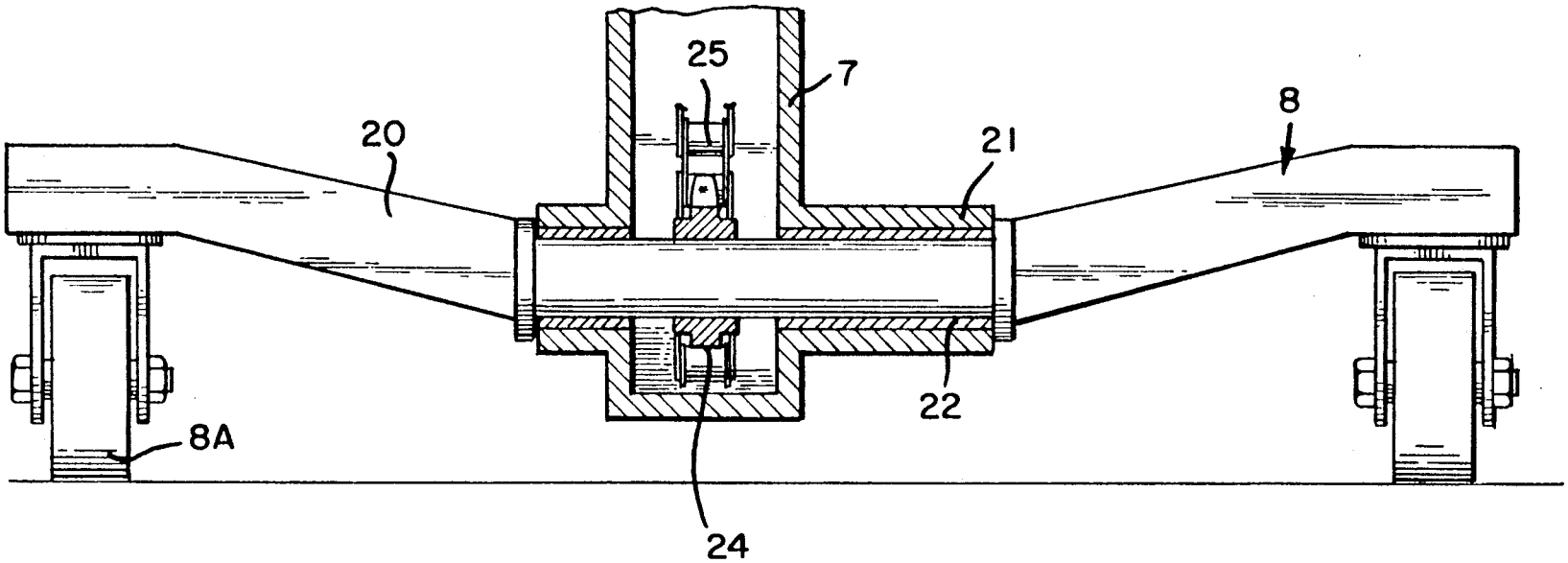
FIG. 9 is a sectional view of the lower part of a footing system.

The elements 19 and 19A are generally rigidly connected and are hinged at a point 11, which is fixed on the girder 1. The end of the arm 19A is hinged at the end of the hydraulic element furnishing motor drive means 26. The arm 19 is preferably hinged to the support leg 7 at a second hinge point 12. The second point 12 is preferably disposed in the center fifth of the extension of the support leg 7. As seen along the lines between the respective hinge points, the arms 19 and 19A have a length where the arm 19 is from about 2 to 5 times, and preferably from about 2.5 to 4 times the length of the arm 19A. The angle between the arms 19 and 19A is preferably 110 to 160 degrees, and more preferably from about 130 to 140 degrees. The length of the support leg 7 can be from about 0.6 to 0.9 times the total length of the girder 1 and is preferably from about 0.7 to 0.8 times the total length of the girder 1 between the hinge points 10, 12. The first hinge point 10 movable along the slider is preferably disposed at a level within a center third of the distance between the level of the hinge point at the end of the piston 51 and the arm 19A and the level of the hinge point between the arm 19A and the piston 51. The point 11 is restrained to move along a circumferential arc for furnishing the motion which will bring the support leg 7 into the withdrawn location illustrated in FIG. 3.

It will be understood that each of the elements described above, or two or more together, may also find a useful application in other types of medical emergency equipment differing from the types described above.

While the invention has been illustrated and described as embodied in the context of a self-contained module for intensive care and resuscitation, it is not intended to be limited to the details shown, since various modifications and structural changes may be made without departing in any way from the spirit of the present invention.

Without further analysis, the foregoing will so fully reveal the gist of the present invention that other can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A self-contained module for intensive care and resuscitation comprising a detachable receiving table (2) for sick and inured persons;

medical and resuscitation assistance equipment; a footing (3) provided with ground-support members (8) including at least a first and a second support leg (7);

a girder (1) supporting the table (2) and the medical and resuscitation equipment and having attached the footing (3) for supporting and controlling the height level and inclination of the girder (1) above the ground;

actuating and guide means attached to the girder (1) and associated with the footing (3), wherein the actuating and guide means actuate the support legs (7) of the footing (3), thereby initiating a folding motion of an actuated, respective leg;

and wherein the actuated support legs perform the folding motion under the girder (1), and wherein the folding motion is performed by a rotary motion around a hinge point (10) and a translation motion along an upper rail (13) and a lower rail (14).

2. The self-contained module for intensive care and resuscitation according to claim 1, wherein the first support leg and the second support leg are foldable simultaneously.

3. The self-contained module for intensive care and resuscitation according to claim 1, wherein the first support leg and the second support leg (7) are independently foldable from each other.

4. The self-contained module according to claim 1, wherein the rotary motion is effected under and toward the girder (1) and toward one extremity of the girder (1) during the folding-up motion, wherein the girder (1) is supported by the support leg (7) in an unfolded position of the support leg (7), while the translational path of the motion of the support leg (7) is effected under the girder (1) and toward the other extremity; and wherein the translation motion is effected under the girder (1) in direction of the extremity of the girder (1) during the unfolding motion, wherein the girder (1) is supported by the support legs (7) in an unfolded position, while the rotary path of the motion of the support leg (7) is effected under the girder (1) in a direction away from the girder (1).

5. The self-contained module according to claim 4, wherein the girder (1) has a recess and wherein, in a folded-up position, the actuating and guide means of the support legs (7) and the support legs (7) themselves become placed in the recess of the girder (1) so as to reduce the ground clearance.

6. The self-contained module according to claim 4, wherein the two support legs (7) and the associated operating and guide means are respectively placed under and in the girder (1) and on both sides of a vertical center plane containing the longitudinal axis of the girder (1).

7. The self-contained module according to claim 1, wherein the actuating and guide means comprise members for guiding in translation along an axis line parallel to the longitudinal axis of the girder (1), which members cooperate with the upper part of the support leg (7), by means of a first hinge point (10);

a rotation guide member follows along a circumferential arc and centered at a point (11) located at a small offset relative to the girder (1), which rotation guide member cooperates by means of a second hinge point (12) with the support leg (7), this second hinge point (12) being located between the first hinge point (10) and the lower end of the support leg (7);

a motor drive means (26) which directly operates to actuate the legs (7).

8. The self-contained module according to claim 7, wherein the legs (7) are actuated via the rotation guide members.

9. The self-contained module according to claim 7, wherein the legs (7) are actuated via the translation guide member.

10. The self-contained module according to claim 7, wherein the motor drive means (26) are non-reversible.

11. The self-contained module according to claim 7, wherein a path of the lower end of each support leg (7) during the folding-up is located within a straight line perpendicular to the girder (1) and passing through said lower end of the respective support leg (7) in view of the completely unfolded support leg (7).

12. The self-contained module according to claim 11, wherein a second hinge point (12) of the support leg (7) is located at mid-distance between the first and lower end of the support leg (7), and where the center point (11) of the circumferential arc, along which this second hinge point (12) moves about, is located within the straight line, recited above, below the axis along which there occurs the translation displacement of the first hinge point (10).

13. The self-contained module according to claim 12, wherein the ground-support member is induced to a translation motion during the folding-up or unfolding of the associated support leg (7) relative to an attached reference point relating at the girder (1).

14. The self-contained module according to claim 1, wherein the ground-support members (8) are hingedly mounted at the end of the their support leg (7) and are interdependent of actuating and guide means which actuating and guide means communicate to ground support members (8) and to the respective support leg (7), relative to an attached reference point, wherein a resulting tilting motion runs simultaneously with the folding-up and unfolding motions of the said support leg (7).

15. The self-contained module according to claim 14, wherein each actuating and guide means of the ground-support member, in relation to the support leg (7) at which it is hinged, is disposed within the said support leg (7).

16. The self-contained module according to claim 14, wherein each actuating and guide means for tilting of the ground-support member, in relation to the support leg (7) at which it is hinged, is formed by:

a first toothed chain wheel (23) disposed coaxial relative to the hinge axis (21) of the first point (10) and fixed both in rotation as well as in translation at the carriage (15), a second toothed chain wheel (23) identical to the first toothed chain wheel (23), disposed coaxial relative to the hinge axis (21) of the structure of the support member, and fixed both in rotation as well as in translation to the said structure, and an endless chain which cooperates by engaging with the first chain wheel (23) and the second chain wheel (24).

17. A self-contained module according to claim 14, wherein each actuating and guide means is formed by a rigid triangle disposed in the support leg (7) associated with thi^ member and attached and fixed in a hinged manner for tilting of the ground-support member relative to the support leg (7), at which it is hinged, said association furnished on the one hand, by its lower end to the structure of the support member and, on the other hand, by its upper end to the carriage (15), where this triangle defines, together with the support leg (7), a deformable parallelogram.

18. The self-contained module for intensive care and resuscitation according to claim 1, wherein the support legs (7) of the footing (3) are actuated independently of one another and subsequent to each other.

19. The self-contained module for intensive care and resuscitation according to claim 1, wherein the folding motion is an unfolding motion.

20. The self-containing module for intensive care and resuscitation according to claim 1, wherein the folding motion is a folding-up motion.

21. A self-contained module for intensive care and resuscitation comprises a detachable receiving table (2) for sick and inured persons, medical and resuscitation assistance equipment units, and a footing (3) provided by ground-support members (8), comprising a girder (1) which supports the medical and resuscitation equipment and the table (2), and which girder (1) is supported above the ground in a controllable manner as to height and inclination by the footing (3), which footing (3) is formed by at least a first and a second support leg (7) connected to actuating and guide means. wherein the actuating and guide means communicates a folding motion to at least one of the support legs (7) under the girder (1) thereby initiating a folding motion of the actuated, respective leg, and wherein the folding motion is performed by a rotary motion around a hinge point (10) and a translation motion along an upper rail (13) and a lower rail (14).

22. A self-contained module for intensive care and resuscitation according to claim 21, wherein the first and second support legs (7) are foldable simultaneously.

23. A self-contained module for intensive care and resuscitation according to claim 21, wherein the first support leg and the second support leg are foldable independently from each other.

24. The self-contained module according to claim 23, wherein the folding-up and unfolding motion of each support leg (7) is formed by a combination of a translation motion with a rotation motion, wherein the rotation motion is effected under and toward the girder (1) and toward one end of the girder (1) during the folding-up, wherein the girder (1) is supported by the support leg (7) in an unfolded position of the support leg (7), while the translational path of the motion of the support leg (7) is effected under the girder (1) and toward the other end;

and wherein the translation motion is effected under the girder (1) in direction of the end of the girder (1) during the unfolding, wherein the girder (1) is supported by the support legs (7) in an unfolded position, while the rotational path of the motion of the support leg (7) is effected under the girder (1) in a direction away from the girder (1)

wherein, in a folded-up position, the actuating means of the support legs (7) and the support legs (7) themselves become placed in the girder (1) so as to reduce the ground clearance;

wherein two units, each formed by the support legs (7) and by the operating and guide means of the support legs (7), are respectively placed under and in the girder (1) and on both sides of a vertical center plane containing the longitudinal axis of the girder (1).

25. The self-contained module according to claim 23, wherein the actuating and guide means comprise members for guiding in translation along an axis line parallel to the longitudinal axis of the girder (1), which members cooperate with the upper part of the support leg (7), by means of a first hinge point (10);

a rotation guide member (19) following along a circumferential arc centered at a point (11) located at the end of the girder (1) which cooperates by means of a second hinge point (12) with the support leg (7), this second hinge point (12) being located between the first hinge point (10) and the lower end of the support leg (7), a motor drive means (26) which directly operates to actuate the unit, wherein the motor means (26) are non-reversible.

26. The self-contained module according to claim 25, wherein the point (11) is located at a small set-off relative to the girder (1).

27. The self-contained module according to claim 25, wherein the motor drive means (26) actuates the rotation guide members.

28. The self-contained module according to claim 25, wherein the motor drive means (26) actuates the translation guide member.

29. The self-contained module according to claim 25, wherein the path of the lower end of each support leg (7) during the folding-up is located within a straight line (D) perpendicular to the girder (1) and passing through said end in considering the completely unfolded support leg (7); and wherein the second hinge point (12) of the support leg (7) is located at mid-distance between the first and the lower end of the support leg (7), and where the center (11) of the circumferential arc, along which this second hinge point (12) moves about, is located within the straight line, recited above, below the axis along which there occurs the translation displacement of the first hinge point (10).

30. The self-contained module according to claim 23, wherein the ground-support members (8) are hingedly mounted at the end of their support leg (7) and are interdependent of actuating means which communicate to ground support members (8) relative to an attached reference point, to their support leg (7), wherein a resulting tilting motion runs jointly with the folding-up and unfolding motions of the said support leg (7);

wherein the ground-support member (8), in relation to an attached reference point relating at the girder (1), is induced to a translation motion during the folding-up and unfolding of the associated support leg (7); and wherein each actuating means of the ground-support member, in relation to the support leg (7) at which it is hinged, is placed in the said support leg (7).

31. The self-contained module according to claim 30, wherein each actuating means for tilting of the ground-support member (8), in relation to the support leg (7) at which it is hinged, is formed by:

a first toothed chain wheel (23) coaxial to the hinge axis (21) of the first point (10) and fixed both in rotation as well as in translation at the carriage (15), a second toothed chain wheel (24) identical to the first toothed chain wheel (23), coaxial to the hinge axis (21) of the structure of the support member (8), and fixed both in rotation as well as in translation to the said structure, an endless chain (25) which cooperates by engaging with the first chain wheel (23) and the second chain wheel (24).

32. The self-contained module according to claim 30, wherein each actuating means for tilting of the ground-support member relative to the support leg (7), at which it is hinged, is formed by a rigid triangle (27) disposed in the support leg (7) associated with this member and attached and fixed in a hinged manner, on the one hand, by its lower end to the structure of the support member (8) and, on the other hand, by its upper end to the carriage (15), where this triangle defines, together with the support leg (7), a deformable parallelogram.

* * * * *